United States Patent [19]

Goff et al.

[11] 4,025,020

[45] May 24, 1977

[54] ROCKER BASE

[75] Inventors: McKinley Goff, Middletown; Edward L. Hampton, Louisville, both of Ky.

[73] Assignee: Leggett & Platt Incorporated, Carthage, Mo.

[22] Filed: Mar. 22, 1976

[21] Appl. No.: 669,263

[52] U.S. Cl. ..... 248/385; 297/303

[51] Int. Cl.[2] ..... A45D 19/04; A47J 47/16

[58] Field of Search ..... 248/372–392; 267/131–133; 297/301–303, 325, 326

[56] References Cited

UNITED STATES PATENTS

| | | | |
|---|---|---|---|
| 215,337 | 5/1879 | Doremus | 248/375 |
| 2,470,907 | 5/1949 | White et al. | 248/388 X |
| 3,220,688 | 11/1965 | Baermann | 248/384 |
| 3,263,955 | 8/1966 | Hunt et al. | 248/385 |
| 3,784,148 | 1/1974 | Hill | 248/382 |

FOREIGN PATENTS OR APPLICATIONS

| | | | |
|---|---|---|---|
| 557,563 | 2/1957 | Italy | 297/302 |
| 92,390 | 7/1958 | Norway | 297/302 |

*Primary Examiner*—Lawrence J. Staab
*Attorney, Agent, or Firm*—Wood, Herron & Evans

[57] ABSTRACT

An improved rocker base of the pivot support type having a novel rocker plate structure. The novel rocker plate structure is used to provide a flat rocker base for a chair, or can be slightly modified to provide a pitched rocker base for a chair, thereby permitting the same rocker springs to be used for either the flat base or the pitched base. The novel rocker plate also includes mounting means that permits the chair's seat to be fixed selectively onto the rocker plate in either a 'hard rock' or a 'soft rock' position, as desired by the user, and whether the rocker base is a flat base or a pitched base.

8 Claims, 7 Drawing Figures

ROCKER BASE

This invention relates to rocking chairs. More particularly this invention relates to an improved rocker base for a rocking chair.

There are at least three main types of rocking chairs known to the prior art. These types are different one from the other in the structure that provides the rocking function. These types include (a) a curved rocker rail or foot structure fixed rigidly to the chair's seat, (b) an all spring support rocker base interposed between the chair's seat and legs, and (c) a pivot support rocker base, with springs, also interposed between the chair's seat and legs. The curved rocker foot type, historically, has been used as a home rocking chair. The spring support and pivot support rocker base structures are commonly used commercially in, for example, business offices.

One particular structure of the pivot support type of rocker base is set forth in U.S. Pat. No. 3,263,955. The rocker base disclosed in this patent has known substantial commercial success in the trade. The rocker base structure disclosed in this patent is of a simple and compact design which provides a very satisfactory degree of rocking action to the user. Further, that rocker base structure may quickly and easily incorporated in a rocking chair during fabrication of the chair. In addition, that rocker base structure provides a rocking chair with a soft, relatively free rocking motion in both directions from a neutral or at-rest position. Also, that rocker base structure provides a rocking chair with a substantially maintenance free rocker base over an extended length useful life.

Specifically, the rocker base structure disclosed in the 3,263,955 patent includes a rocker plate to which the chair's seat is fixed, that rocker plate having front and rear ends. The rocker base also includes a base plate fixed to legs which support the chair's seat above ground level. The rocker plate is pivotally connected to the base plate on a horizontal axis, that axis being positioned between the center and the rear end of the rocker plate. Double action springs connect the rocker plate and the base plate adjacent at the front end thereof, the springs and the pivot axis cooperating to define a neutral position for the chair's seat when same is unused. The double action springs function to permit a repetitive rocking movement about the pivot axis during each oscillation of the rocker plate (and, therefore, the chair's seat) forwardly and rearwardly through the chair's neutral position. The double action springs resist by tension at least the extreme portion of the rocking movement of the rocker plate in one direction, e.g., backward, from the neutral position, and resist by compression at least the extreme portion of the rocking movement of the rocker plate in the opposite direction, e.g., forward, from the neutral position. A rear compression spring is provided between the rear end of the rocker plate and the pivot axis. The rear compression spring is interposed between the racker and base plates to cushion at least a portion of the backward rocking movement by compression.

In the manufacture of rocking chairs, and particularly in the manufacture of rocking chairs adapted for commercial use in business offices, there are a couple of problems that arise because of the wide diversity of potential users, and because of the range of personal tastes of those users. The potential user may desire a chair with a hard rock or a soft rock, i.e., one user may desire harder or softer flexure or rocking characteristics from another user. Also, the potential user may desire a chair which, when at rest, establishes the chair's seat in a horizontal attitude or establishes the seat in a pitched angulated attitude. These possible variations in consumer tastes for the rocking chair structure lead to multiple different rocker base structures, each rocker base having different parts from the other to accommodate for the variations which must be provided in the chair line offered to the trade.

Accordingly it has been one objective of this invention to provide an improved pivot support rocker base of the type disclosed in U.S. Pat. No. 3,263,955, that improved rocker base including a novel rocker plate which can be easily modified so that the same basic rocker plate can be used in the manufacture of a rocking chair having a horizontal seat, or a rocking chair having a pitched seat, while using the same non-adjustable springs for each.

In accord with these objectives, the improved rocker base of this invention is of the pivot support type and includes a novel rocker plate structure. The novel rocker plate structure is used to provide a flat rocker base for a chair, or can be slightly modified to provide a pitched rocker base for a chair, thereby permitting the same rocker springs to be used for either the flat base or the pitched base. The novel rocker plate also includes mounting means that permits the chair's seat to be fixed selectively onto the rocker plate in either a 'hard rock' or a 'soft rock' position, as desired by the user, and whether the rocker base is a flat base or a pitched base.

Other objectives and advantages will be more apparent from the following detailed description taken in conjunction with the drawings in which.

Figure 1:
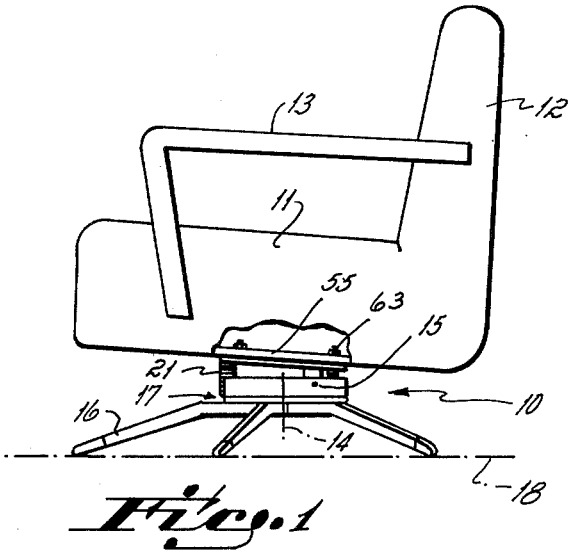
FIG. 1 is a side elevational view illustrating the improved rocker base of this invention, same mounting a seat in the pitched attitude when the chair is in a neutral or unused position.

The improved rocker base 10 of this invention is illustrated as applied to a swiveled rocking chair, but also is suited for use with a non-swiveled rocking chair. The swiveled rocking chair shown in the Figures includes a seat 11 and backrest 12 rigidly structured into a single unit, same also including arm rests 13 on either side of the chair. This conventional unit is supported by the improved rocker base 10 which is constructed in accordance with the invention.

The rocker base 10 supports the seat 11 for rotational or swivel movement about a central vertical axis 14, and for rocking movement about a rearwardly offset horizontal axis 15. The rocker base 10 basically includes a series of legs 16, and a swivel structure 17 fixed to the legs to establish the rotational function of the chair's seat relative to the ground 18. The rocker base 10 also basically includes a base plate 19 connected to the swivel structure 17, a rocker plate 20 fixed to the chair's seat 11 and pivotally connected to the base plate and springs 21 connected between the rocker and base plates to establish the rocking function of the chair's seat relative to the ground 18.

Figure 4:
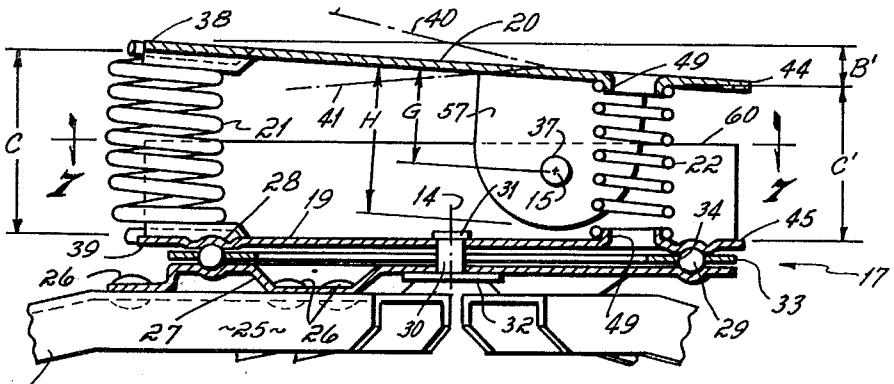
FIG. 4 is a cross-sectional view taken along line 4—4 of FIG. 3.

As illustrated in FIGS. 1 and 4, the chair's legs 16 extend radially outward from center axis 14 and from beneath the approximate center of the chair's seat 11. The inner end 25 of each leg 16 is rigidly secured by rivets 26 or other fixed securements to a rigid leg plate 27. The swivel structure 17, which is mounted on the legs 16, includes the leg plate 27 as the lower stationary plate of that swivel structure. The base plate 19 constitutes the upper rotary plate of the swivel structure. The top surface of the leg plate 27 and the bottom surface of the base plate 19 are configured to establish annular ball bearing races 28 containing ball bearings 29, the ball bearings cooperating with the plates 19, 27 to space same apart one from the other and to provide a rolling bearing means between same, thereby permitting rotation of base plate 19 relative to legs 16 about vertical axis 14. The leg plate 27 and the base plate 19 are held in fixed axial relation one with the other by a center bolt 30 having a head 31 at its upper end abutting the top surface of the base plate 19 and a head 32 at its lower end abutting the bottom surface of the leg plate 27. A bearing retainer ring 33, which is adapted to receive individual bearings 29 in holes 34 spaced about that ring 33, cooperate also in retaining the bearings within races 28 during swivel use of the chair.

Figure 5:
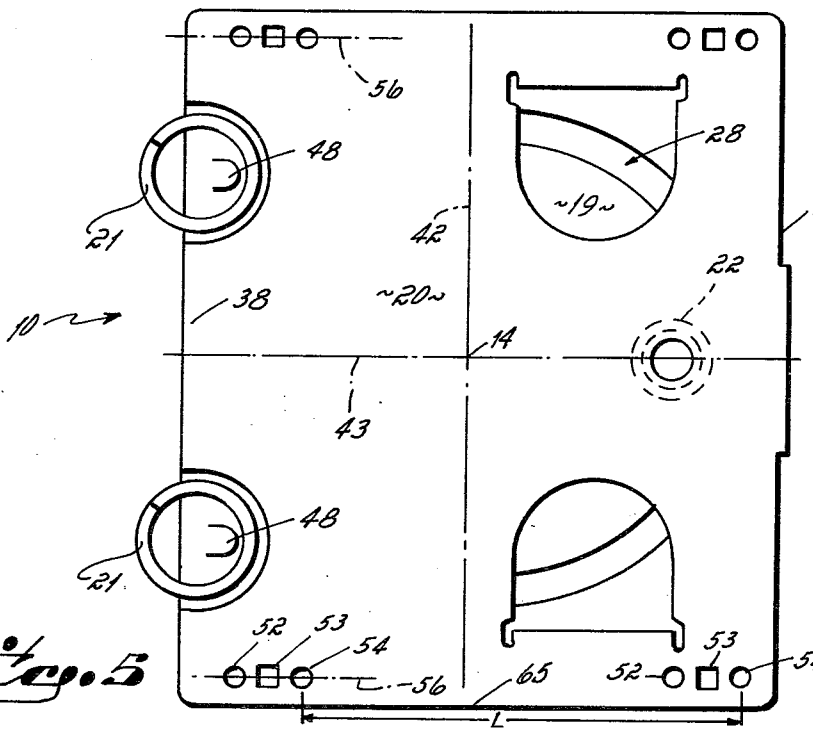
FIG. 5 is a top view of the rocker base illustrated in FIG. 4.

The rocker plate 20 is pivotally connected to the base plate 19 by rivets 37 on the horizontal axis 15, see FIGS. 4 and 5. The rocker plate 20 is spaced vertically a desired distance above the base plate 19, this spacing being minimized to promote compactness. Rocking movement of the rocker plate 20 on the base plate 19 about axis 15 is primarily controlled by a pair of double acting front springs 21 located between and anchored to the front end portions 38, 39 of the rocker plate and the base plate, respectively. In other words, and relative to a transverse vertical plane 42 that includes the base's center axis 14 (that transverse vertical plane being normal to a longitudinal vertical plane 43 that symmetrically divides the chair's rocker base 10, seat 11 and backrest 12 in mirror images and also includes vertical axis 43), the double action front springs 21 interconnect the rocker plate 19 and the base plate 27 at the front end 38, 39 of the rocker base. The front springs 21 are operative to resist or cushion by tension at least the extreme portion of the backward rocking movement (shown by phantom line 40 in FIGS. 4 and 7) of the rocker plate from the neutral position (shown in solid lines in FIGS. 4 and 7), and to resist or cushion by compression at least the extreme portion of the forward rocking movement (shown by phantom line 41 in FIGS. 4 and 7) of the rocker plate from that same neutral position.

The front springs 21 are double action normally open coil springs connected between and firmly anchored to the front edges 38, 39 of both the rocker plates 20 and the base plate 19, respectively. The anchorage of each spring 21 to each plate 19, 20 is accomplished by inserting the front edge of the plate between the last two spring coils at one end of the spring. A tongue 48, previously formed in the plates 19, 20 during manufacture, is then bent outwardly to abut the inside of the last spring coil, thereby holding same against slipping out of its position on the respective plate. This same type of anchorage is provided at both ends of both springs 21 and this double anchorage renders the springs double acting. By a double acting spring is meant a spring which, on one side of a neutral position, acts in tension and, on the opposite side of that neutral position, acts in compression. The double action front springs 21 cooperate, at the front end 38, 39 of the rocker base 10, to cushion at least the extreme portion of the forward rocking movement by compression, and to cushion at least the extreme portion of the backward rocking movement by tension. Otherwise expressed, when the rocker plate 20 is rocked backward, as shown in dotted lines 40 in FIGS. 4 and 7, its front edge 46 rises and places the front springs 21 in tension. The tension resistance of the springs 21 progressively increases as the rocker plate 20 rocks backward. The rocking of the rocker plate 20 forward from its neutral position lowers the front edge 38 of the rocker plate and places the front springs 21 in compression. This compressive resistance of the springs 21 progressively increases the further the rocker plate 20 is rocked forward. Hence, the maximum resistance applied by the springs 21 to the rocker plate 20 will be at the extreme limits of its rocking movement in both directions. Of course, the front springs 21 are sized so that, when relaxed or in equilibrium, they will maintain or hold the rocker plate 20 substantially in the neutral position shown in full lines in FIGS. 4 and 7.

The rear spring 22 is located between the rear end portions 44, 45 of the base plate 19 and the rocker plate 20, respectively, same being held in operative position between the plates 19, 20 by annular ribs 49 formed on the surface of each plate. In other words, and relative to the transverse vertical plane 42, the rear spring 22 is interposed between, but does not connect with, the base plate 19 and the rocker plate 20 at the rear end 44, 45 of the rocker base 10. Note that the rear spring 22 is operatively disposed between the rocking plate 20 and the base plate 19 on the side opposite the pivot axis 15 from the transverse vertical plane 42, i.e., the double acting springs 21 are located on one side of the pivot axis 15 and the rear spring 22 is located on the other side of that axis. The rear spring 22 is operative to resist at least the extreme portion of the backward rocking movement of the rocker plate 20 by compression, but is inoperative to resist forward rocking movement of the rocker plate since it is not permanently fixed at either end to either the rocker 20 or the base 19 plate. As illustrated, no means for adjusting the compression of the rear spring 22 is provided, but such an adjustment is contemplated within the scope of this invention. Otherwise expressed, as illustrated, the rear spring 22 is not anchored to the rocker plate 20 or the base plate 19, but is separable from both, so that when the rocker plate is rocked forward from its neutral position, its rear end portion 44 tends to lift off the spring (but does not because of the spring's compression), rather than placing same in tension. Hence, the rear spring 22 offers no resistance to forward rocking movement of the rocker plate 20, but rather resists or cushions some portion of the rearward rocking movement of that rocker plate.

The number of springs 21, 22 used may be varied as desired to achieve the desired rocking characteristics for the chair. For example, one single or integral double action normally open coil spring may be used at the front 38, 39 of the rocker base 10 instead of the two shown, or two single action coil springs may be used at the rear 44, 45 of the rocker base 10 instead of the one shown.

Figure 7:
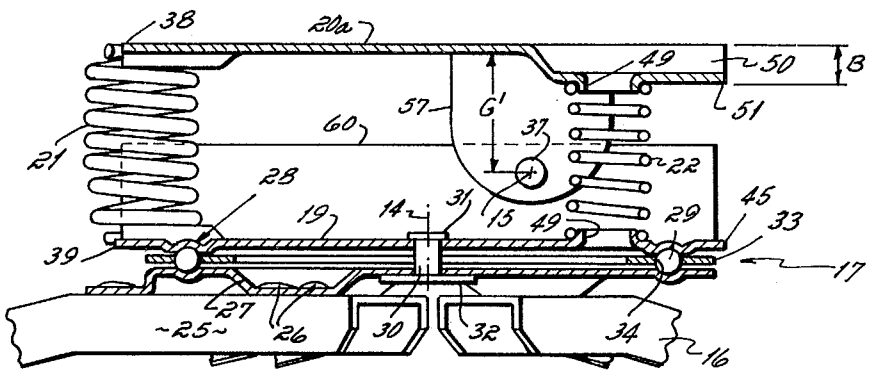
FIG. 7 is a view similar to FIG. 4, but showing that modification of the rocker base which permits the chair's seat to achieve the FIG. 2 attitude in the neutral position.
Figure 6:
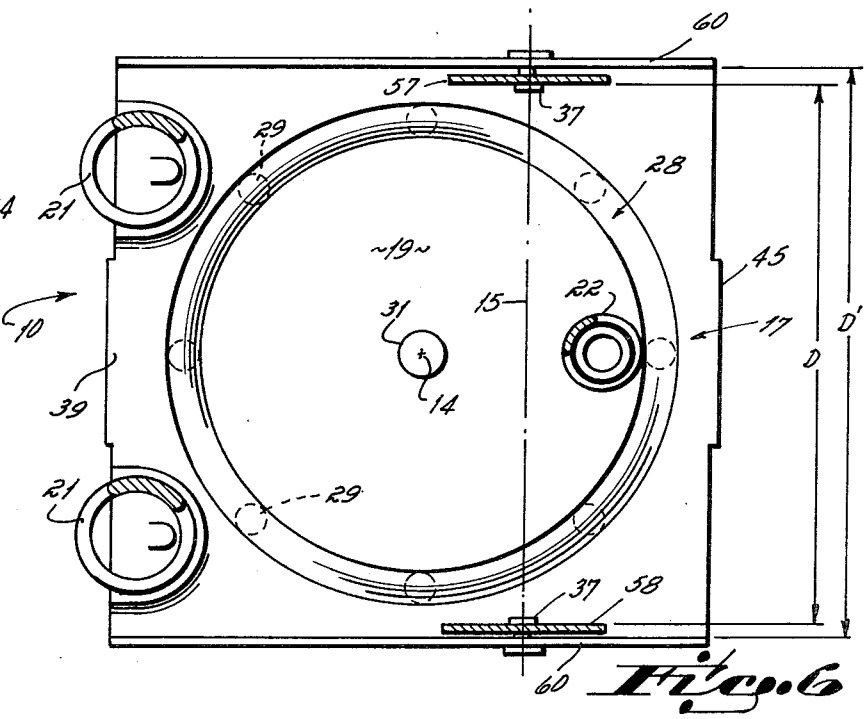
FIG. 6 is a cross-sectional view taken along line 6—6 of FIG. 4.

The structure of the rocker plate 20 itself is the focal point of the novel features of the improved rocker base of this invention. The basic rocker plate 20 is illustrated in FIGS. 3–6, and a modified rocker plate 20*a* is illustrated in FIG. 7. Both rocker plates 20, 20*a*, however, are substantially identical in structure one to the other, same differing only by virtue of the fact that the modified rocker plate 20*a* incorporates a depressed boss 50 adjacent the rear edge 51 thereof, see FIG. 7, whereas the basic rocker plate 20 has not such boss, see FIG. 4. The rocker plate 20, 20*a* is generally rectangular in configuration, the periphery of same having no protrusions extending therefrom. Each corner of the rocker plate 20, 20*a* is provided with three bolt mounting holes 52, 53, 54 for the chair seat's mounting rails 55, the bolt mounting holes at each corner being disposed in a line 56 parallel to the longitudinal center plane 43 of the rocker base 10. The rocker plate 20 also includes a pair of pivot ears 57, 58 disposed toward the rear edge 44 or 51 of that plate, the ears being punched out from the interior surface area of the rocker plate, i.e., the ears not extending beyond the regular geometrical periphery of the rocker plate. The pivot ears 57, 58 are sized identical one with the other, one ear being provided on each side of the center plane 43. The ears 57, 58 are punched out from the rockerplate 20 in a manner that provides each with a fold line 59 disposed parallel to the longitudinal center plate 43 of the rocker base 10, those fold lines being equally spaced from the center plane, and being spaced one from the other a distance D slightly less than the distance D′ between upturned side flanges 60 of the base plate 19. In structural combination with the base plate 19, the rocker plate's ears 57, 58 lie inside of the base plate's upturned flanges 60 in juxtaposition thereto, rivets 37 holding the ears in a pivot mounting relation with the upturned flanges of the base plate and, thereby, providing a pivot mounting of the rocker plate with the base plate on pivot axis 15 as previously discussed.

Figure 2:
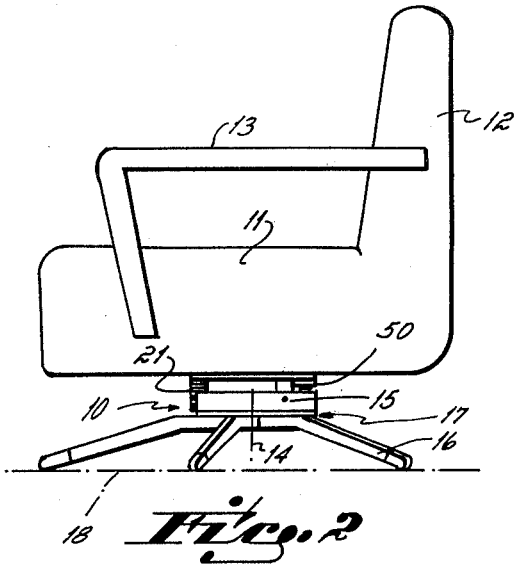
FIG. 2 is a view similar to FIG. 1 but showing a seat mounted in the horizontal or flat attitude when the chair is in a neutral or unused position.
Figure 3:
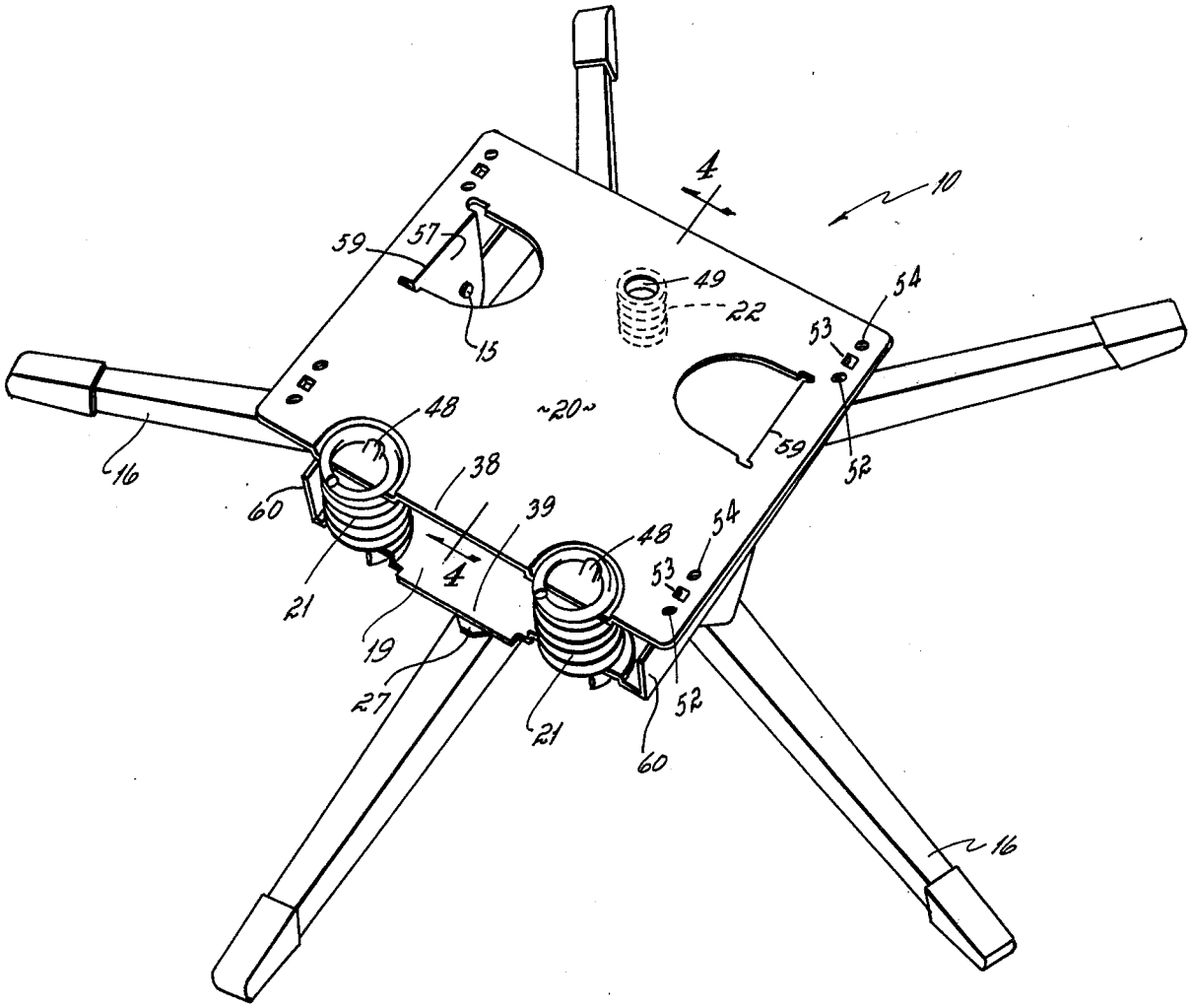
FIG. 3 is a top persective view illustrating the rocker base of FIG. 1 but with the chair's seat removed.

As shown in FIGS. 4 and 5, the pivot mounting location of each ear 57, 58 with the base plate's side flanges 60 can be selected relative to the planar plate 20 itself so as to fabricate a pitched rocker base 10, see FIG. 1, or a flat rocker base 11, see FIG. 2. Such selection is available because height H of the ears 57, 58 is such as to accommodate either pivot mounting location. As shown in FIG. 4, a gap G is established between the rocker plate's underside and the pivot axis 15 so as to provide the rocker plate 20 in a pitched attitude relative to the base plate 19, thereby providing an improved rocker base for a chair in the pitched attitude as illustrated in FIG. 1. In this structural configuration it will be apparent that the double action front springs 21 have a set center-to-center distance C when same are in the neutral position illustrated in FIG. 4, and that the rear spring 22 also has a set center-to-center distance C′ when in the neutral position illustrated in FIG. 4, the neutral positions of the front springs and the rear spring cooperating with the pivot axis 15 location in the rocker plate's ears to establish the pitched attitude of the rocker plate 20 relative to the base plate 19.

When it is desired to fabricate a chair with the seat 11 in a flat or horizontal non-use position, as illustrated in FIG. 2, the rocker plate 20 need merely be provided with the depression or inwardly directed boss 50 at the rear edge 51 thereof. The boss must be of a depth B equal to the height B′ necessary to raise the rear edge of the rocker plate 20 from the pitched FIG. 4 position to the horizontal FIG. 5 position. Note that the length H of the ears 57, 58 is sufficient to accommodate pivot mounting of the ears of the same location on the base plate's side flange 60 when a flat rocker base is fabricated, the gap G′ between the pivot axis 15 and the rocker plate 20 being greater than the gap G established when the rocker plate is mounted in the pitched attitude. Providing the boss 50 in the rocker plate 20 permits the same double action front springs 21, as well as the same rear compression spring 22, to be used in the flat rocker base as in the pitched rocker base, thereby providing manufacturing efficiency. Thus, a pitched rocker base or a flat rocker base chair can be fabricated from the novel rocker plate 20, the structure and configuration of the springs 21, 22, the rocker plate and the base plate 19 being identical for both bases with the exception of added boss 50 in the rocker plate for the flat rocker base.

In addition to making use of the improved rocker base of this invention for a flat seat chair, FIG. 2, or a pitched seat chair, FIG. 1, same can also be used to provide a chair with either a hard rock or a soft rock, depending on the desires of the customer. The chair seat's frame is provided with two mounting bolts 63 at two fixed locations along each of the seat's spaced, parallel side rails 55, those side rails extending longitudinally of the center plate 43 of the rocker base 10 when the seat 11 is fixed to that base. The mounting bolts 63 are spaced one from the other a distance equal to the distance L between respective pairs 52, 52 or 53, 53 or 54, 54 pairs of mounting holes along side edges 65 of the rocker plate 20, and are not movable along the mounting rail 55 of the chair. The mounting holes 52–54 at each corner of the rocker plate 20 are divided into three sets, namely, a forward set, an intermediate set, and a rearward set, each set being adapted to receive the mounting bolts 63 in the chair's support rails 55 in fixed relation therewith. When the mounting bolts 63 of the chair are attached to the rocker plate 20 in the forward set 52, 52 of mounting holes, the rocking chair is provided with a hard rock; when the mounting bolts are attached to the rocker plate in the rearward set of mounting holes 54, 54 the chair is provided with a soft rock; and when the mounting bolts are attached to the rocker plate in the middle set of mounting holes 53, 53, the chair is provided with a medium rock. Thus, the multiple sets 52–54 of mounting holes provided in the rocker plate 20 itself permit the chair's seat 11 and rocker base 10 to be fabricated so as to provide the user with a hard rock, or a soft rock, or a medium rock, as desired by the user, and depending upon which set of mounting holes is used to bolt the seat 11 to the rocker plate. Of course, once the chair's seat 11 is bolted to the rocker plate 20, the hard or medium or soft rock characteristic of the chair cannot be changed unless the mounting location of the seat 11 on the rocker plate 20 is changed.

Having described in detail the preferred embodiment of our invention, what we desire to claim and protect by Letters Patent is:

1. An improved rocker base for a rocking chair of the pivot support type, said rocker base being adaptable for use in any one of a pitched rocker base with hard rock position, a pitched rocker base with soft rock position, a flat rocker base with hard rock position, and a flat rocker base with soft rock position, said improvement comprising a base plate, a rocker plate selected from the group consisting of a first rocker plate having means for receiving a spring at one position relative to said first plate and a second rocker plate having means for receiving a spring at another position relative to said second rocker plate, connector means for pivotally connecting said rocker plate to said base plate on a horizontal pivot axis, said connector means being structured to permit a pivotal connection point between said rocker plate and said base plate to be selected from one for the flat rocker base and another for the pitched rocker base while retaining substantially the same horizontal pivot axis with respect to the base plate, a compression spring interposed between the rear end of said rocker plate and the rear end of said base plate, said compression spring being of the same spring characteristics for both flat and pitched rocker bases, and said compression spring cooperating with said spring receiving means of said first rocker plate in a flat rocker base and cooperating with said spring receiving means of said second rocker plate in a pitched rocker base, the respective relationship of the spring receiving positions on said first and second rocker plates to the respective pivotal connection points being such that said compression spring is normally compressed substantially the same amount for both said flat rocker base and said pitched rocker base, at least one double action spring fixed adjacent the other end of said base at one spring end to said rocker plate and at the other spring end to said base plate, and mounting means on said rocker plate, said mounting means being cooperatively engageable with the chair's seat to permit selective mounting of the chair's seat onto said rocker plate in one of the hard rock and soft rock positions.

2. An improved rocker base for a rocking chair of the pivot support type, said rocker base being adaptable for use in any one of a pitched rocker base with hard rock position, a pitched rocker with soft rock position, a flat rocker base with hard rock position, and a flat rocker base with soft rock position, said improvement comprising a rocker plate selected from the group consisting of a first rocker plate having means for receiving a spring at one position relative to said first plate and a second rocker plate having means for receiving a spring at another position relative to said second rocker plate, said rocker plate having at least one ear cut out of said rocker plate within the periphery thereof, said ear being folded downwardly along a fold line provided within the interior of said plate's periphery, a base plate having an upstanding flange fixed thereto, said base plate being pivotally connected to said rocker plate on a horizontal pivot axis through said ear and said flange, said ear being of sufficient length to permit a pivotal connection point between said ear and said flange to be selected from one for the flat rocker base and another for the pitched rocker base while retaining substantially the same horizontal pivot axis for both the flat and pitched rocker bases, a compression spring interposed between the rear end of said rocker plate and the rear end of said base plate, said compression spring being of the same spring characteristics for all flat and pitched rocker bases, and said compression spring cooperating with said spring receiving means of the first rocker plate in the flat rocker base and cooperating with said spring receiving means of the second rocker plate in the pitched rocker base, the respective relationship of the spring receiving positions on said first and second rocker plates to the respective pivotal connection points being such that said compression spring is normally compressed substantially the same amount for both said flat rocker base and said pitched rocker base, at least one double action spring fixed adjacent the other end of said base at one spring end to said rocker plate and at the other spring end to said base plate, and mounting means on said rocker plate, said mounting means being cooperatively engageable with the chair's seat to permit selective mounting of the chair's seat onto said rocker plate in one of the hard rock and soft rock positions.

3. An improved rocker base as set forth in claim 1, said connector means including an upstanding flange fixed to said base plate, and a rocker plate ear pivotally connected to said flange, said flat rocker plate attitude and said pitched rocker plate attitude being selected by changing said pivotal mounting point of said ear with said flange.

4. An improved rocker base as set forth in claim 1, said first rocker plate being structurally modified with a boss to permit use of the same compression spring in both of said flat base and pitched base attitudes.

5. An improved rocker base as set forth in claim 1 wherein said mounting means includes at least two bolt holes located along each side edge of said rocker plate, said holes being adapted to receive bolts fixed to the chair seat's support rails, the forward one of said bolt holes on each side edge providing one of hard rock and soft rock positions and the rearward one of said bolt holes on each side edge providing the other of said soft rock and hard rock positions.

6. An improved rocker base as set forth in claim 3, said rocker plate including at least one ear cut out of said rocker plate within the periphery thereof, said ear being folded downwardly along a fold line provided within the interior of said plate's periphery.

7. An improved rocker base as set forth in claim 2, said first rocker plate being structurally modified with a boss to permit use of the same compression spring in both of said flat base and pitched base attitudes.

8. An improved rocker base as set forth in claim 2 wherein said mounting means includes at least two bolt holes located along each side edge of said rocker plate, said holes being adapted to receive bolts fixed to the chair seat's support rails, the forward one of said bolt holes on each side edge providing one of hard rock and soft rock positions and the rearward one of said bolt holes on each side edge providing the other of said soft rock and hard rock positions.

* * * * *